US009045837B2

(12) United States Patent
Woltering et al.

(10) Patent No.: US 9,045,837 B2
(45) Date of Patent: Jun. 2, 2015

(54) ELECTROLYSER WITH COILED INLET HOSE

(75) Inventors: Peter Woltering, Neuenkirchen (DE); Randolf Kiefer, Marl (DE); Rainer Weber, Odenthal (DE); Andreas Bulan, Langenfeld (DE)

(73) Assignee: UHDENORA S.P.A., Milan (IT)

( * ) Notice: Subject to any disclaimer, the term of this patent is extended or adjusted under 35 U.S.C. 154(b) by 94 days.

(21) Appl. No.: 13/994,042

(22) PCT Filed: Nov. 15, 2011

(86) PCT No.: PCT/EP2011/005738

§ 371 (c)(1),
(2), (4) Date: Jun. 24, 2013

(87) PCT Pub. No.: WO2012/079670

PCT Pub. Date: Jun. 21, 2012

(65) Prior Publication Data

US 2013/0256151 A1 Oct. 3, 2013

(30) Foreign Application Priority Data

Dec. 15, 2010 (DE) ..... 10 2010 054 643

(51) Int. Cl.
*C25B 9/08* (2006.01)
*C25B 15/08* (2006.01)
*C25B 1/46* (2006.01)

(52) U.S. Cl.
CPC . *C25B 15/08* (2013.01); *C25B 1/46* (2013.01); *C25B 9/08* (2013.01)

(58) Field of Classification Search
CPC ..... C25B 1/46; C25B 9/08; C25B 15/08
USPC ..... 204/263; 205/618
See application file for complete search history.

(56) References Cited

U.S. PATENT DOCUMENTS 4,417,970 A 11/1983 Yamaguchi et al.
2005/0183949 A1 * 8/2005 Daly et al. ..... 204/242
2007/0221496 A1 9/2007 Bohnke et al.

FOREIGN PATENT DOCUMENTS

DE 9413003.5 U1 10/1994
WO 2007/061319 A1 5/2007

OTHER PUBLICATIONS

International Search Report issued in counterpart PCT Application No. PCT/EP2011/005738.

*Primary Examiner* — Nicholas A Smith
(74) *Attorney, Agent, or Firm* — Lucas & Mercanti, LLP

(57) ABSTRACT

Electrolyzer comprising at least one single electrolyzer element which comprises at least one anode compartment with an anode, one cathode compartment with a cathode and one ion exchange membrane arranged between the anode and the cathode compartments, with the anode and/or cathode being a gas diffusion electrode. A gap is provided between the gas diffusion electrode and the ion exchange membrane, with an electrolyte inlet arranged at the upper end of the gap and an electrolyte outlet at the lower end of the gap and a gas inlet and a gas outlet. The electrolyte outlet extending into a discharge header, and the electrolyte inlet connected to an electrolyte feed tank and having an overflow, the overflow connected to the discharge header, with a coiled hose connecting the electrolyte feed tank with the electrolyte inlet and with a coiled hose connecting the overflow with the discharge header.

17 Claims, 10 Drawing Sheets

A

B

C

D

B

C

D

E

ELECTROLYSER WITH COILED INLET HOSE

This application is a U.S. national stage of PCT/EP2011/005738 filed on Nov. 15, 2011 which claims the benefit of priority from German Patent Application No. 102010054643.7 filed Dec. 15, 2010, the contents of each of which are incorporated herein by reference.

FIELD OF THE INVENTION

The present invention may be assigned to the technical field of electrolysis equipment.

The present invention relates to an electrolyser as characterised in the preamble of claim 1.

BACKGROUND OF THE INVENTION

During electrolysis electric energy is converted into chemical energy. This is achieved by the decomposition of a chemical compound by the action of an electric current. The solution used as electrolyte contains positively and negatively charged ions. Therefore, mainly acids, bases or salts are used as electrolytes.

In the production of halogen gases from aqueous alkali halide solution, for example, the following reaction takes place on the anode side:

$$4NaCl \rightarrow 2Cl_2 + 4Na^+ + 4e^- \quad (1)$$

The liberated alkali ions move to the cathode where they form akaline lye with the hydroxide ions obtained there. In addition, hydrogen is formed:

$$4H_2O + 4e^- \rightarrow 2H_2 + 4OH^- \quad (2)$$

The lye obtained is removed from the sodium chloride, which is fed to the anode side, by means of a cation exchange membrane, thus achieving separation. Membranes of this kind are state-of-the-art and commercially available from various suppliers.

The standard potential generated on the anode when the above reaction takes place is +1.36 V, with the standard potential on the cathode being −0.86 V when the above reaction takes place. A cell design of this type is known from, for example, WO98/55670. From the difference between these two standard potentials results an enormous input of energy, which is required to conduct these reactions. In order to minimise this differential amount, gas diffusion electrodes (hereinafter referred to as GDEs) are used on the cathode side, by which means oxygen enters the system with the result that on the cathode the following reaction will take place instead of reaction (2):

$$O_2 + 2H_2O + 4e^- \rightarrow 4OH^- \quad (3)$$

The overall reaction when using the NaCl-GDE technology is hence defined as follows:

$$4NaCl + O_2 + 2H_2O \rightarrow 4NaOH + 2Cl_2 \quad (4)$$

As the standard potential of reaction (3) is +0.4 V, the NaCl-GDE technology results in a significant energy saving as compared to the conventional technology.

Gas diffusion electrodes have been used for many years in batteries, electrolysers and fuel cells. The electrochemical conversion takes place inside these electrodes at the so-called three-phase boundary only. Three-phase boundary is the term used for the area where gas, electrolyte and metallic conductor get into contact with one another. To make the GDE work effectively, the metallic conductor should at the same time be a catalyst for the desired reaction. Typical catalysts in alkaline systems are silver, nickel, manganese dioxide, carbon and platinum. To be particularly efficient, these catalysts must have a large surface area. This is achieved by finely divided or porous powders with specific surface area.

Problems in the use of such gas diffusion electrodes as disclosed in U.S. Pat. No. 4,614,575, for example, are due to the fact that the electrolyte would penetrate into these fine pore structures due to capillary action and fill them up. This effect would make the oxygen stop diffusing through the pores, thus stopping the intended reaction.

To achieve that the reaction takes place effectively at the three-phase boundary, the above problem is to be avoided by selecting adequate pressure ratios. The formation of a liquid column in a liquid at rest, as applies to the electrolyte solution, causes, for example, the hydrostatic pressure to be highest at the lower end of the column, which would enhance the phenomenon described above.

As documented in the relevant literature, this problem is solved by falling-film evaporators. Here, the lye is percolated through a porous material positioned between the membrane and the GDE, thus preventing the formation of a hydrostatic column. This is also referred to as percolation technology.

WO03/042430 suggests to use polyethylenes of high density or perfluorinated plastic materials for this porous percolating layer.

A principle of such kind is disclosed in DE102204018748, for example. Here, an electrochemical cell is described which consists of at least one anode compartment with an anode, one cathode compartment with a cathode and one ion exchange membrane arranged between the anode compartment and the cathode compartment, with the anode and/or cathode being a gas diffusion electrode, and a gap being provided between the gas diffusion electrode and the ion exchange membrane, and an electrolyte inlet being arranged at the upper end of the gap and an electrolyte outlet at the lower end of the gap as well as a gas inlet and a gas outlet, with the electrolyte inlet being connected to an electrolyte feed tank and having an overflow.

The electrolyte overflow is to ensure uniform feed across the whole width of the cell. The amount of electrolyte flowing from the feed tank into the electrolyte inlet depends on the difference in height between the liquid level of the electrolyte in the feed tank and the liquid level in the electrolyte inlet. The liquid level in the electrolyte inlet, in turn, depends on the height of the overflow which determines the volume of electrolyte dammed up in the electrolyte inlet.

If more electrolyte is supplied than can flow off via the overflow channel and the gap, the pressure of the electrolyte will increase in the channel-type electrolyte inlet at the upper end of the gap. The pressure in the electrolyte inlet can be adjusted by the height selected for the overflow channel. By increasing the pressure it is hence possible to pass a larger amount of electrolyte through the gap and the flow velocity inside the gap can be varied as required. By varying the ratios of the before-mentioned differences in height to one another it is possible to adjust the pressure in the electrolyte inlet as desired.

An electrolyser is referred to as an apparatus which is built up by a plurality of electrically contacted plate-type electrolysis cells arranged side by side in a stack, said cells having inlets and outlets for all liquids and gases supplied and produced. In other words, a plurality of single elements is connected in series, each element having electrodes that are separated from each other by a suitable membrane and fitted in a frame for holding these single elements. Electrolysers of such kind are disclosed, for example, in DE 196 41 125 A1 and DE 102 49 508 A1.

To protect the metal components, such as nickel, copper, silver and gold, of which an electrolysis cell with gas diffusion electrode is made, a polarisation can be performed during a downtime period as, for example, during start-up, shutdown, operational interruptions or failures. This is, for example, the case when an electrolysis cell is filled and heated for being put into operation. When the cell is taken out of electrolysis operation, the polarisation is likewise to be maintained until the anodic liquid is free of chlorine and has cooled down.

The polarisation current ensures that the metal components of the electrolysis cell are within a potential range which does not allow any corrosion reactions causing the dissolution of the metals of which the individual components of the cell cathode are made. The intensity of the polarisation current is to be selected so high that, after losses due to stray currents resulting from electrolyte feed and discharge operations, a sufficiently positive current intensity is still available in the centre of the electrolyser to ensure a defined potential range which does not allow any critical corrosion reactions.

The following shall deal with an electrochemical cell for the conventional hydrogen-producing chlor-alkali electrolysis arranged according to the state of the art disclosed in DE 196 41 125 A1 and DE 102 49 508 A1. To ensure that electrolysis cells of such kind function properly, a minimum polarisation current is to be maintained when the main electrolysis current has been turned off in order to protect the electrode coating from corrosion reactions. The way to achieve an adequate corrosion protection by polarisation currents which are as low as possible by means of a discharge channel in connection with a PTFE discharge tube is described in DE 102 49 508 A1. Here, that part of the fed polarisation current that is discharged via the electrolytes in the feed and discharge lines of the cell is minimised by the constructional measures mentioned. The feed of brine and lye is implemented via a conventional inlet manifold.

To quantify these currents, an electrolyser 1, as shown in FIG. 1A, shall be dealt with as an example in the following, the electrolyser consisting of 160 single electrolyser elements which are arranged in two electrolyser stacks 2 and 3. This electrolyser is fed with a polarisation current of 27 A on the anode side so that, without losses by stray currents, an overall voltage of theoretically approximately 250V is reached. By means of an electric model which includes the different ohmic resistances of the element components and the electrolytes as well as the respective electrochemical equations it is possible to calculate the course of the current intensity of each element. The results are shown in FIG. 1B which depicts the current of the element in relation to the element number, i.e. the position in the electrolyser.

It shows that only approx. 40% of the current reaches the elements, the other 60% are lost via stray currents. FIG. 1C and FIG. 1D give a detailed representation of the stray currents, which are conducted via the electrolyte feed and discharge flows of each element. FIG. 1C depicts stray currents in relation to the element number, i.e. the element position in the electrolyser, the stray currents being carried off via the brine feed lines (represented by unfilled triangles) and the lye feed lines (represented by filled triangles). FIG. 1D, in comparison, gives a detailed representation of the flows that are lost via the lye discharge line (shown by filled triangles) and the anolyte discharge line (shown by unfilled triangles). The disadvantage of this technology is hence that very large stray currents are produced which, in turn, require high polarisation currents.

SUMMARY OF THE INVENTION

The use of the above-described technologies in an electrolyser of such kind is problematic in so far as a uniform feed with electrolyte is required not only for the single element but also for all single elements connected in series in order to ensure effective operation. Despite the overflows provided for the single elements, the lye is frequently distributed unevenly during electrolyser operation owing to varying pressures, which will also contribute to the above-described problem of stray current formation, which, in turn, will cause corrosion and decrease the current yield.

The objective of the present invention therefore is to provide a design that ensures even distribution of the electrolyte during electrolyser operation comprising a plurality of single electrolyser elements by providing a constant pressure in the electrolyte feed device and sufficient amounts of electrolyte. A further objective is to avoid increased electric stray currents resulting from, for example, uneven distribution of electrolyte in order to keep the necessary polarisation currents as low as possible.

The objective is achieved by the use of an electrolyser comprising at least one single electrolyser element which comprises at least one anode compartment with an anode, one cathode compartment with a cathode and one ion exchange membrane arranged between the anode compartment and the cathode compartment, with the anode and/or cathode being a gas diffusion electrode, and a gap being provided between the gas diffusion electrode and the ion exchange membrane, with an electrolyte inlet being arranged at the upper end of the gap and an electrolyte outlet at the lower end of the gap as well as a gas inlet and a gas outlet, with the electrolyte outlet extending into a discharge header, and with the electrolyte inlet being connected to an electrolyte feed tank and having an overflow, the overflow being connected to the discharge header, with a coiled hose being provided for connecting the electrolyte feed tank with the electrolyte inlet and with a coiled hose being provided for connecting the overflow with the discharge header.

Another embodiment of the invention provides for coiled hoses of a length of 1.5 m to 3.5 m, preferably of 1.75 to 3 m and most preferably of 2.25 to 2.75 m. Hoses of a length of 2.5 m are of particular advantage.

Advantageously coiled hoses are provided, which are of an inside diameter of 5 mm to 15 mm, preferably an inside diameter of 7.5 to 12.5 mm and most preferably of 9 mm to 11 mm. Of particular advantage are hoses of an inside diameter of 10 mm.

Preferably the overflow is provided with a through aperture of a diameter of 2 mm to 4 mm and preferably of 2.5 to 3.5 mm.

In a preferred embodiment the electrolyser is provided with 50 to 200 single electrolyser elements, preferably 70 to 180 single electrolyser elements, and most preferably 100 to 160 single electrolyser elements.

Furthermore, the present invention provides for the electrolysis of an aqueous alkali halide solution. During operation the pressure drop at the overflow fitted with the coiled hose is up to 200 mbar, preferably 100 to 200 mbar.

Furthermore, the pressure drop in the preferred embodiment at the electrolyte inlet fitted with the coiled hose is 30 mbar to 200 mbar, preferably 80 to 170 mbar, and most preferably 100 mbar to 150 mbar.

The hoses used are preferably made of PTFE.

BRIEF DESCRIPTION OF THE DRAWINGS

The present invention is illustrated in detail by means of figures.

FIG. 1A shows a schematic arrangement of an electrolyser of such kind. FIG. 1B shows the course of the current intensity in relation to the single elements constituting the electrolyser. FIG. 1C shows the stray currents which are conveyed via brine and lye feed of each element, FIG. 1D the stray currents which are conveyed via the catholyte discharge (lye discharge) and anolyte discharge.

FIG. 2A shows a schematic arrangement of an electrolyser according to the invention. FIG. 2B shows the course of the element voltage under polarisation in relation to the single elements constituting the electrolyser. FIG. 2C shows the course of the current intensity under polarisation in relation to the single elements constituting the electrolyser. FIG. 2D shows the stray currents which are carried off via the brine and lye feed of each element. Here, the stray currents via the brine feed streams are represented by filled circles, the stray currents via the lye feed streams by unfilled circles. FIG. 2E shows the stray currents which are lost via anolyte discharge, catholyte discharge and catholyte overflow. The stray currents via the anolyte discharge lines are represented by filled triangles, the stray currents via the catholyte discharge lines by unfilled squares, the stray currents via the catholyte overflow lines by unfilled rhombi.

DETAILED DESCRIPTION OF THE INVENTION

In a test for comparison with the prior art, an electrolyser according to the present invention which had been equipped with the coiled hoses described in claim 1 was used. The electrolyser tested consisted of four electrolyser stacks, each comprising 60 single electrolyser elements. The at first theoretically resulting overall voltage under polarisation without stray current losses amounts here as well to a maximum of 250V, i.e. the mere ohmic resistance of the electrolyser under polarisation is within the range of the prior-art electrolyser, the results of which are described in FIG. 1 so that the latter can be compared directly with the results shown in FIG. 2.

FIG. 2A shows the current flow through electrolyser 4 according to the invention. The electrolyser stacks are provided with reference numbers 5, 6, 7, 8. Here as well, the electrolyser is supplied with a polarisation current from the anode end, the current originating from polarisation rectifier 9.

In the case of the electrolyser according to the invention a current input of 27 A is not enough to ensure a minimum current in the centre of the electrolyser. The calculations have proved that current is carried off via the electrolytes in the feed and discharge lines to such an extent that the positive current in the centre elements of the electrolyser is no longer sufficient. Therefore the polarisation current input was increased to 50 A and the cell voltage (FIG. 2B) and the current (FIG. 2C) in each element calculated using the same calculation method as applied to FIG. 1. FIGS. 2B and 2C show the calculation result in the form of the course in relation to the elements of the electrolyser.

Figure 1:
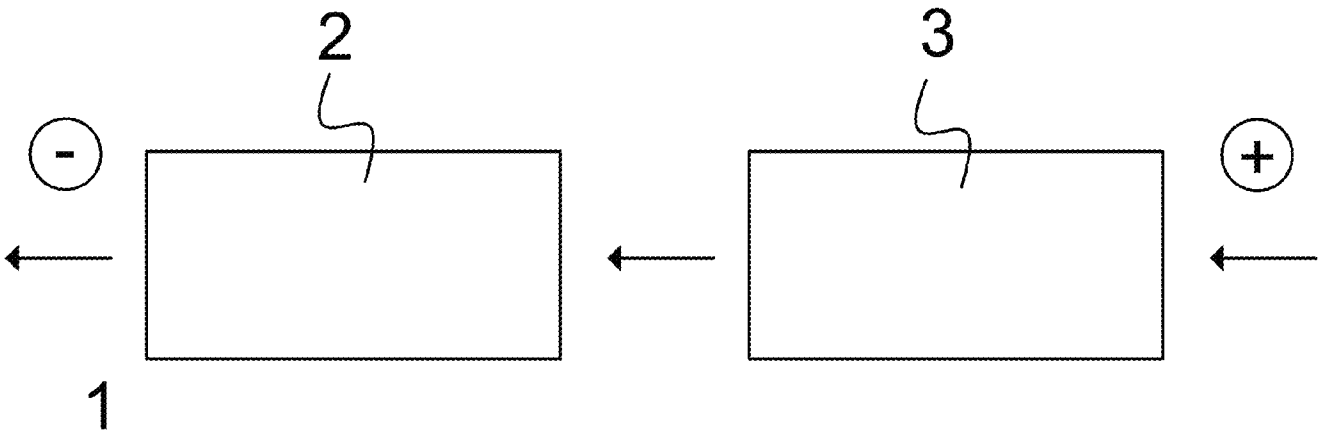
FIG. 1: Prior-art electrolyser.
Figure 1:
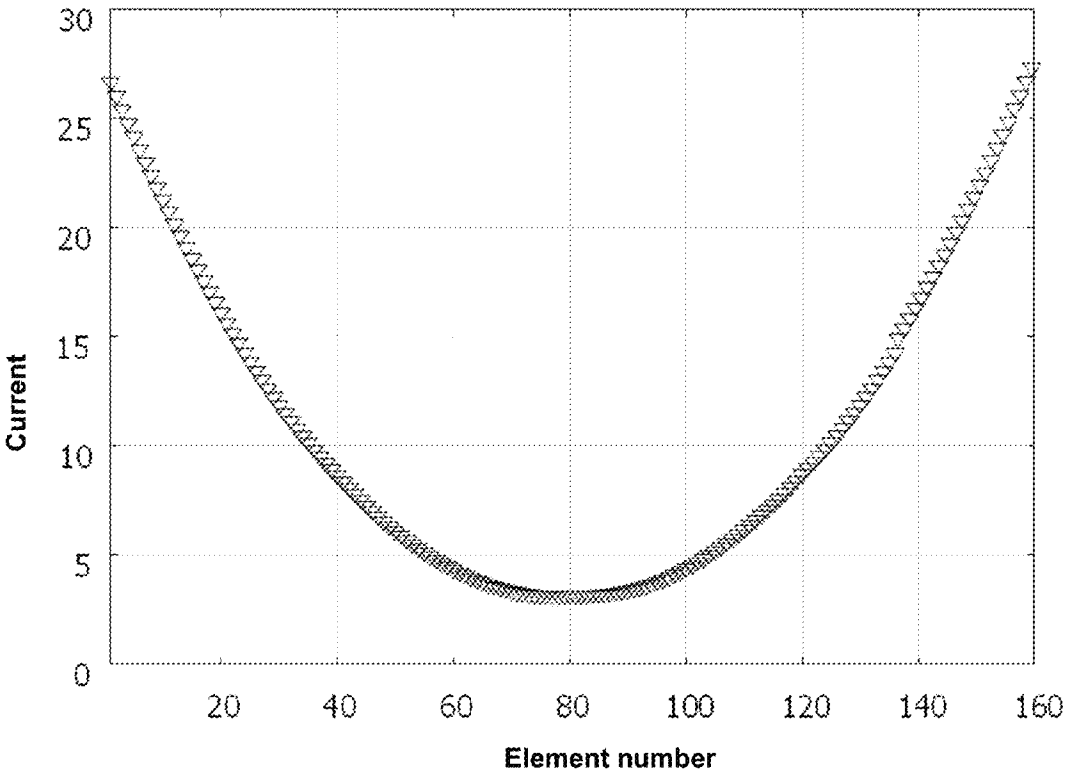
Figure 1:
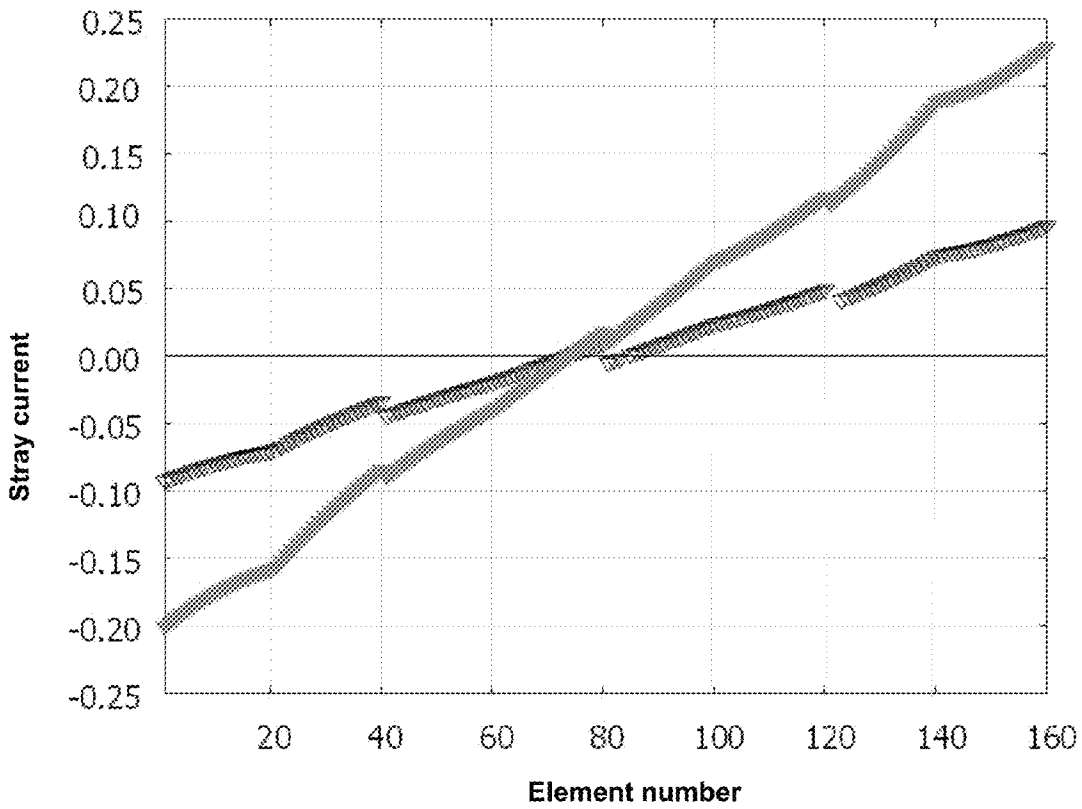
Figure 1:
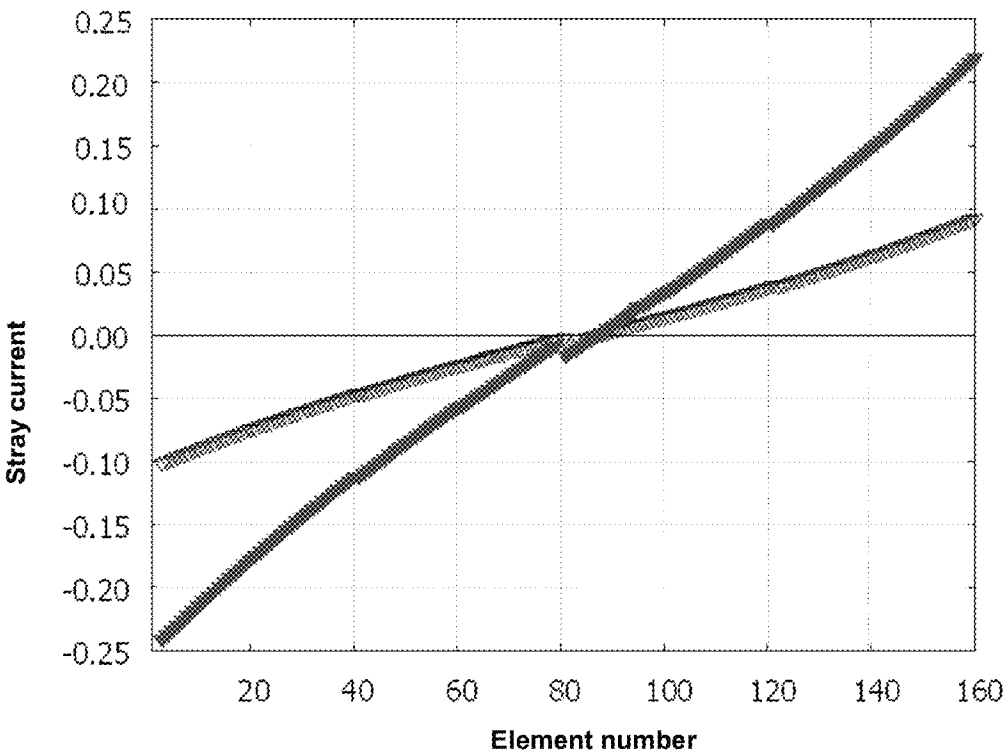
Figure 2:
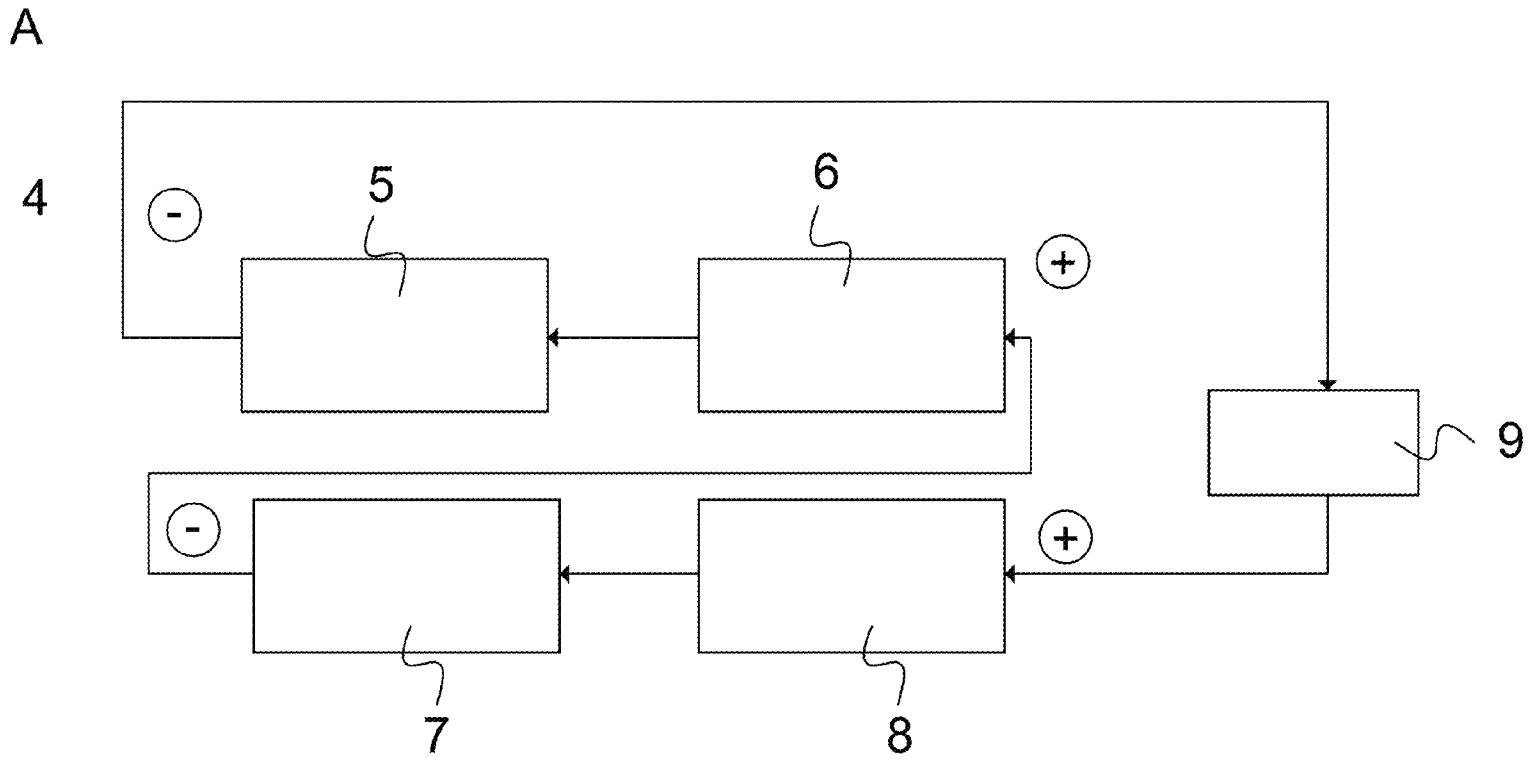
FIG. 2: Electrolyser according to the invention.
Figure 2:
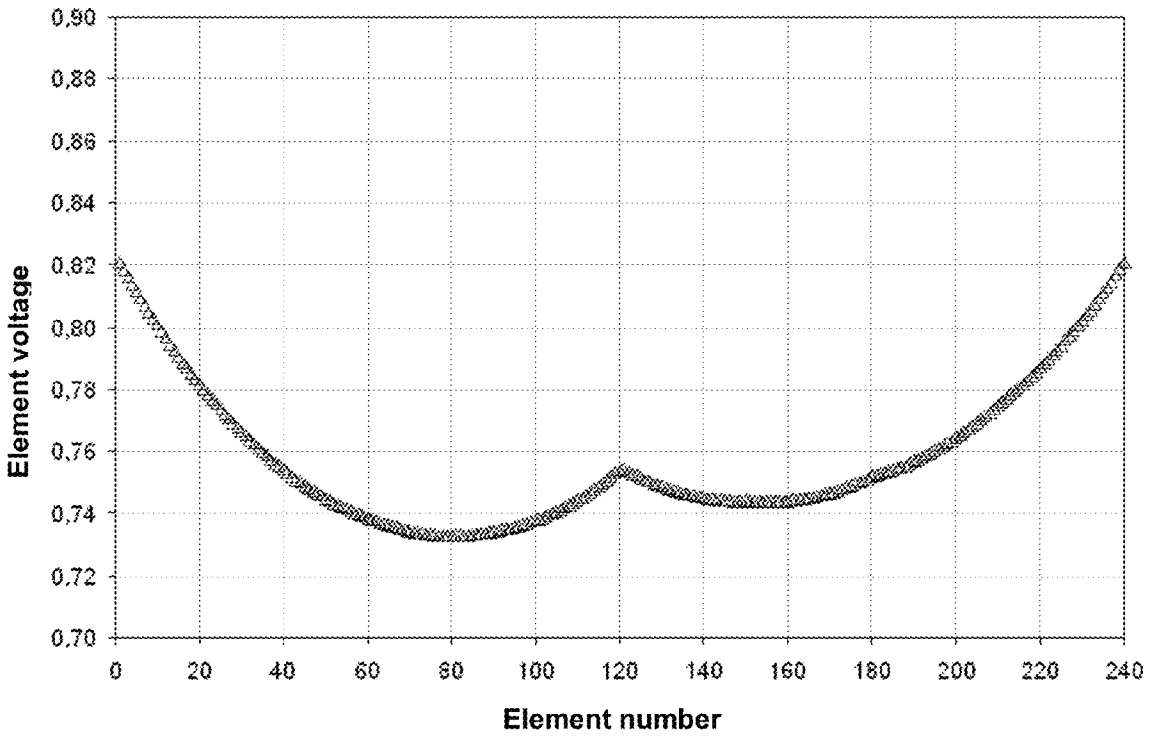
Figure 2:
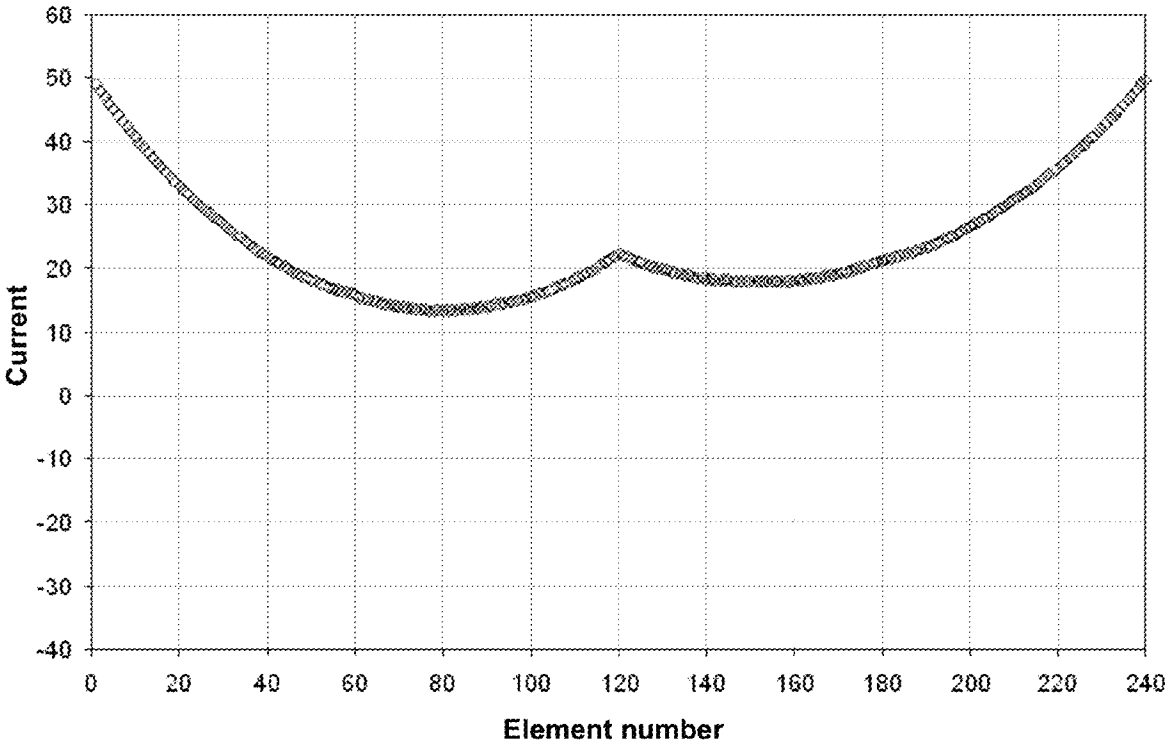
Figure 2:
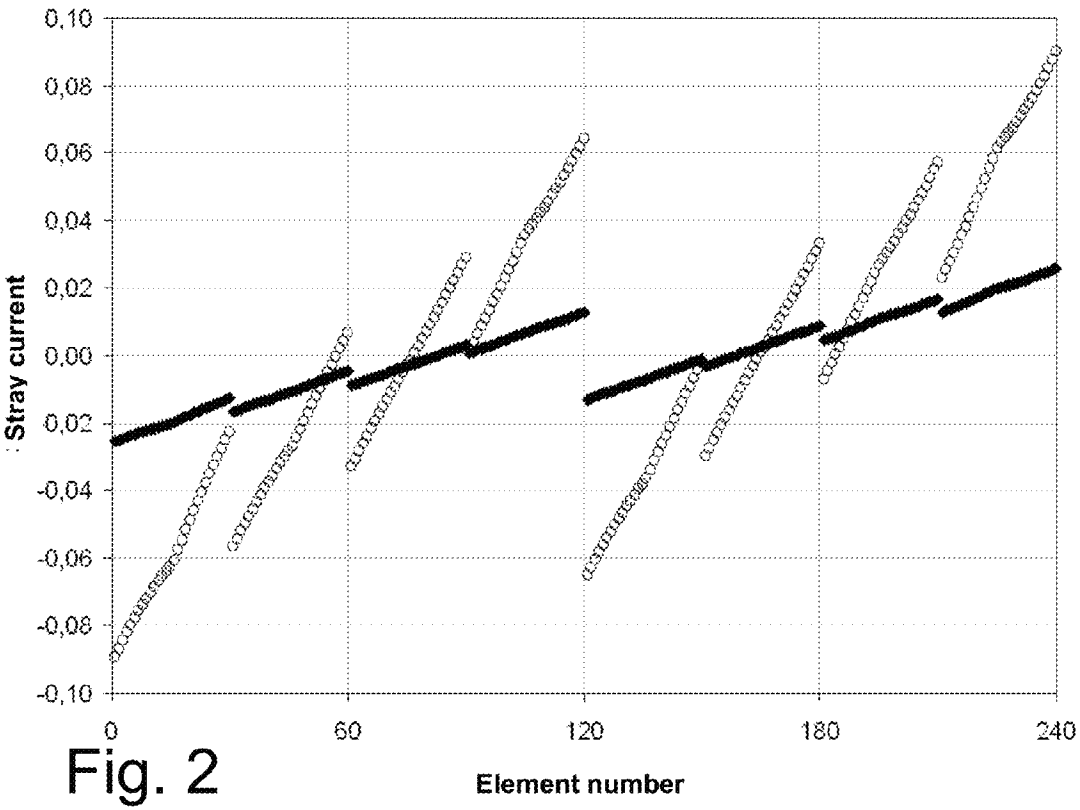
Figure 2:
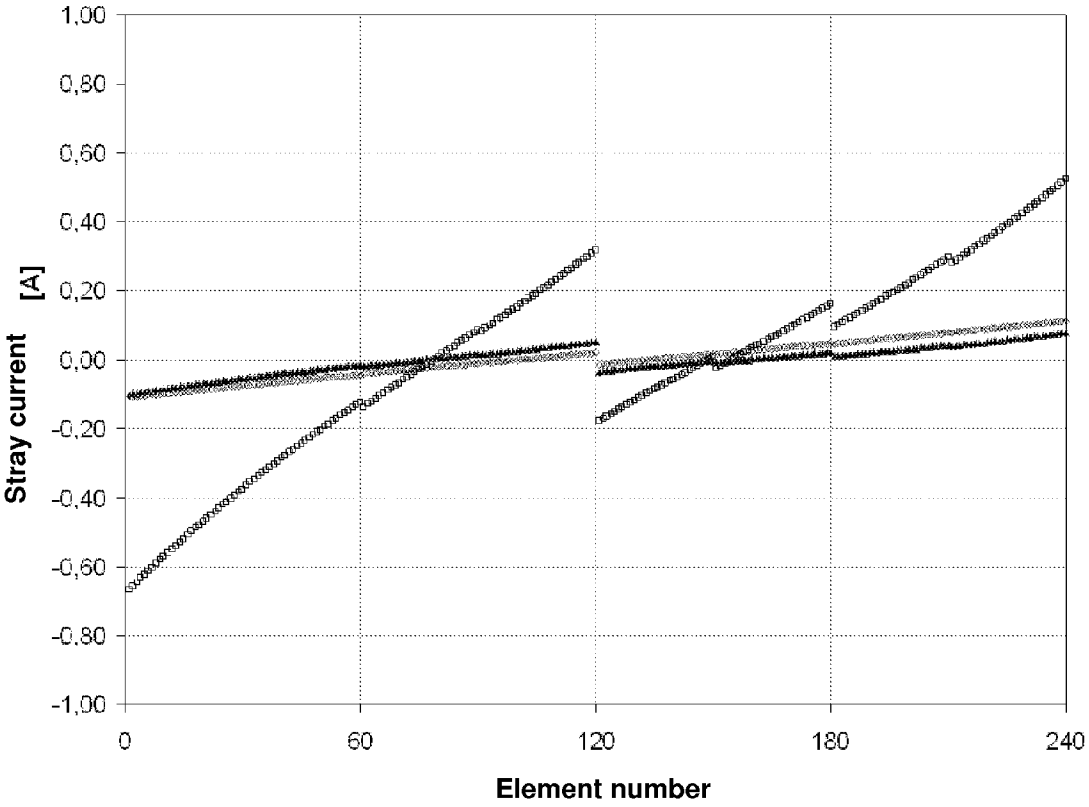

As in the example of a conventional electrolyser acc. to FIG. 1 the current decreases to a notable degree and reaches its lowest level in the centre elements of the electrolyser. A look at the course of the stray currents via the feed and discharge streams of each single cell element gives a picture as shown in FIG. 2C and FIG. 2D.

While the stray currents in the brine feed and anolyte discharge streams are low and qualitatively do not deviate significantly from the amounts known from the calculations of the conventional electrolyser shown in FIG. 1, the calculations for the catholyte side show a different picture.

A look at the calculation results shown in FIG. 2C for the electrolyte inlet, which was provided with a coiled PTFE inlet hose of, a length of 2.5 m and an inside diameter of 10 mm and connects the electrolyte inlet with an electrolyte feed tank, shows that the extent of the stray current loss is higher than the loss via the brine feed. On the whole, however, the stray current loss is smaller by the factor 2 than in the conventional technology shown in FIG. 1. The decreased stray current is hence due to the use of the coiled hose.

As the feed, the catholyte overflow is ensured by a coiled PTFE inlet hose of a length of 2.5 m and an inside diameter of 10 mm, connecting the fitted overflow with the discharge header. As shown in FIG. 2D, the overflow features a low stray current, which is scarcely different from the stray current loss via the brine feed (cf. FIG. 2C). Despite the necessary higher polarisation current of 50 A, this stray current is of a similar magnitude as the stray current that is lost at 27 A via the catholyte feed in the conventional electrolysis cell (cf. FIG. 1C).

Therefore, the installation of coiled electrolyte inlet and overflow hoses ensures that stray currents in the operation of an electrochemical cell are kept as low as possible, although the polarisation current to be fed is to be slightly higher than in the conventional chlor-alkali electrolysis in order to efficiently prevent corrosion processes.

Figure 3:
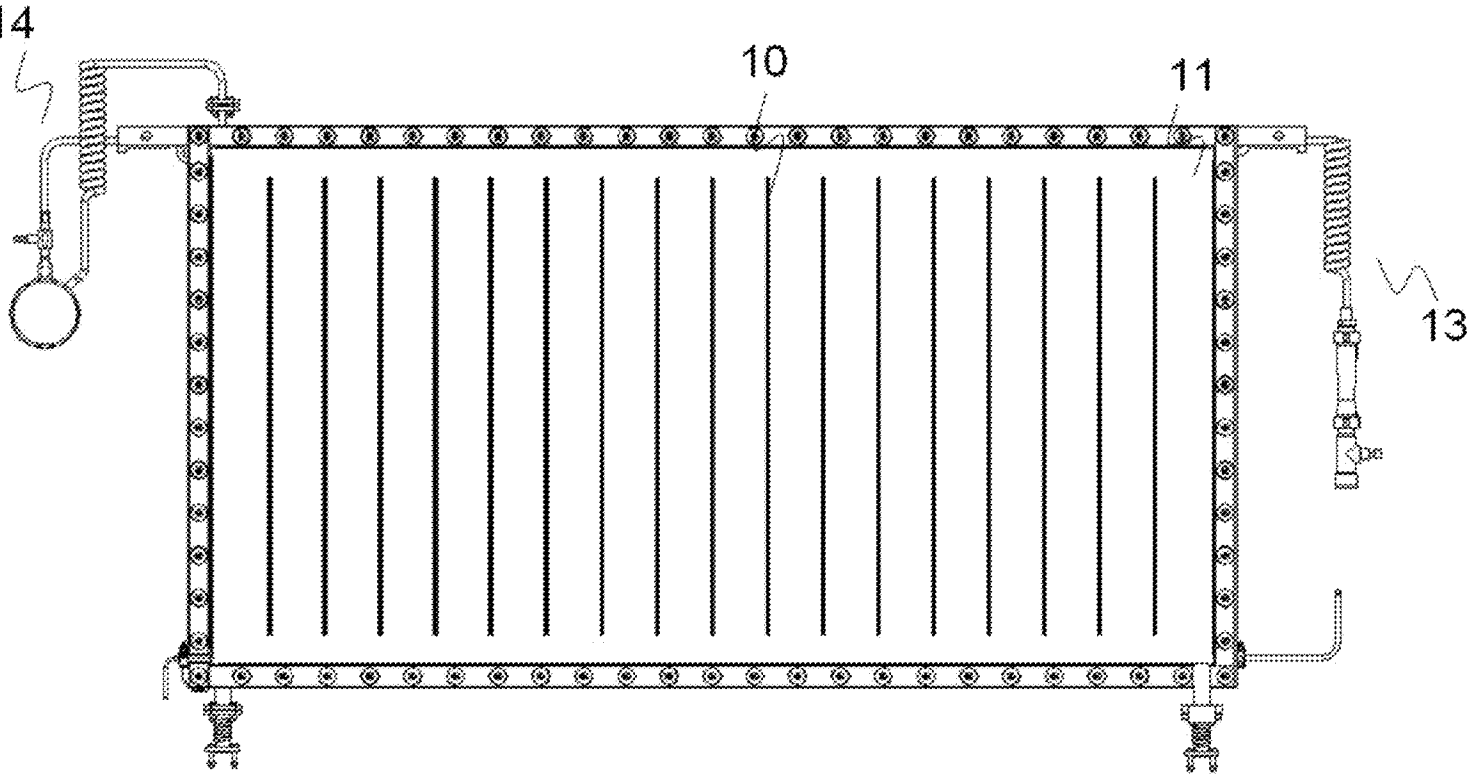
FIG. 3: Side view of a single electrolyser element according to the invention provided with fitted coiled hoses.

FIG. 3 shows a single electrolyser element 10 according to the invention. It does not show the inside arrangement of the electrolysis cell. The claimed electrolysers are created by arranging a plurality of single electrolyser elements 10 side by side in so-called cell stacks into devices provided for this purpose. In so doing, the single electrolyser elements are connected via contact strips 12 provided in the outer wall 11 in a way to ensure electric conductivity, with the current flowing through the operating electrolyser from the anode end.

The electrolyte is filled in via a coiled hose 13. In this way the electrolyte flows evenly across the whole width of the single electrolyser element 10. The electrolyte feed is implemented from top to bottom via a falling film (not shown).

The overflow of the electrolyte is also provided with a coiled hose 14. In installed condition, this overflow is connected in an exemplary mode to the oxygen discharge channel from where excessive electrolyte can be discharged into the discharge header of the electrolyser (not shown).

The simultaneous throttling effect of coiled hoses 13 and 14 ensures even distribution of the electrolyte during electrolyser operation by providing a constant pressure in the electrolyte feed device and sufficient amounts of electrolyte.

The throttling effect of coiled hose 13 also prevents that a considerable part of the electrolyte entering through coiled hose 14 leaves the single electrolyser element by a siphon effect, instead of flowing—as intended—in a falling film through the single electrolyser element. By the embodiment of coiled hose 13 it is thus possible to prevent electrolyte depletions in parts of the single electrolysis cell which would detrimentally affect the electrolytic operating mode of the single electrolysis cell.

Optionally, the electrolyte amount can be adjusted by means of a valve and a flow meter in the electrolyte feed prior to entering coiled hose 14 if strongly varying back pressures occur in the elements arranged in electrolyser stacks. The flow rate is adjusted by valves and flow meters such that a minimum electrolyte stream is maintained in coiled hose 14 in order to ensure a necessary inlet pressure by the hydrostatic column thus obtained. The achieved stray current minimisation and the even electrolyte distribution both require the interplay of the two coiled hoses fitted to the electrolyte single elements.

Advantages of the present invention:

Even distribution of electrolyte in the electrolyser.

Assured availability of sufficient amounts of electrolyte in the falling film by preventing electrolyte losses as a result of a siphon effect in the electrolyte overflow of each single electrolyser element.

Minimisation of stray currents by which necessary polarisation currents can be kept low.

Measure that can be easily integrated into existing electrolysers.

LIST OF REFERENCE NUMBERS AND DESIGNATIONS

1 Electrolyser
2 Electrolyser stack
3 Electrolyser stack
4 Electrolyser
5 Electrolyser stack
6 Electrolyser stack
7 Electrolyser stack
8 Electrolyser stack
9 Polarisation rectifier
10 Single electrolyser element
11 Outer wall
12 Contact strips
13 Coiled hose
14 Coiled hose

We claim:

1. Electrolyser comprising at least one single electrolyser element which comprises at least one anode compartment with an anode, one cathode compartment with a cathode and one ion exchange membrane arranged between the anode compartment and the cathode compartment, with the anode and/or cathode being a gas diffusion electrode, and a gap being provided between the gas diffusion electrode and the ion exchange membrane, with an electrolyte inlet being arranged at the upper end of the gap and an electrolyte outlet at the lower end of the gap as well as a gas inlet and a gas outlet, with the electrolyte outlet extending into a discharge header, and with the electrolyte inlet being connected to an electrolyte feed tank and having an overflow, the overflow being connected to the discharge header, wherein a coiled hose is provided for connecting the electrolyte feed tank with the electrolyte inlet and a coiled hose is provided for connecting the overflow with the discharge header.

2. Electrolyser according to claim 1, wherein coiled hoses of a length of 1.5 m to 3.5 m, are provided.

3. Electrolyser according to claim 1, wherein coiled hoses are provided which are of an inside diameter of 5 mm to 15 mm.

4. Electrolyser according to claim 1, wherein the overflow is provided with a through aperture of a diameter of 2 mm to 4 mm.

5. Electrolyser according to claim 1, wherein 50 to 200 single electrolyser elements are provided.

6. Electrolysis of an aqueous alkali halide solution by means of an electrolyser according to claim 1, wherein the pressure drop at the overflow fitted with the coiled hose is up to 200 mbar.

7. Electrolysis of an aqueous alkali halide solution according to claim 6, wherein the pressure drop at the electrolyte inlet fitted with the coiled hose is 30 mbar to 200 mbar.

8. Electrolyser according to claim 2, wherein coiled hoses of a length of 1.75 m to 3 m are provided.

9. Electrolyser according to claim 2, wherein coiled hoses of a length of 2.25 m to 2.75 m are provided.

10. Electrolyser according to claim 3, wherein coiled hoses are provided which are of an inside diameter of 7.5 mm to 12.5 mm.

11. Electrolyser according to claim 3, wherein coiled hoses are provided which are of an inside diameter of 9 mm to 11 mm.

12. Electrolyser according to claim 4, wherein the overflow is provided with a through aperture of a diameter of 2.5 mm to 3.5 mm.

13. Electrolyser according to claim 5, wherein 70 to 80 single electrolyser elements are provided.

14. Electrolyser according to claim 5, wherein 100 to 160 single electrolyser elements are provided.

15. Electrolysis of an aqueous alkali halide solution according to claim 6, wherein the pressure drop at the overflow fitted with the coiled hose is 100 to 200 mbar.

16. Electrolysis of an aqueous alkali halide solution according to claim 7, wherein the pressure drop at the electrolyte inlet fitted with the coiled hose is 80 to 170 mbar.

17. Electrolysis of an aqueous alkali halide solution according to claim 7, wherein the pressure drop at the electrolyte inlet fitted with the coiled hose is 100 to 150 mbar.

* * * * *